US012637791B2

(12) United States Patent
Suzuki

(10) Patent No.: US 12,637,791 B2
(45) Date of Patent: May 26, 2026

(54) UPPER AND SHOE

(71) Applicant: ASICS CORPORATION, Kobe (JP)

(72) Inventor: Chihaya Suzuki, Hyogo (JP)

(73) Assignee: ASICS CORPORATION (JP)

( * ) Notice: Subject to any disclaimer, the term of this patent is extended or adjusted under 35 U.S.C. 154(b) by 12 days.

(21) Appl. No.: 18/377,106

(22) Filed: Oct. 5, 2023

(65) Prior Publication Data

US 2024/0115004 A1 Apr. 11, 2024

(30) Foreign Application Priority Data

Oct. 7, 2022 (JP) ..... 2022-162150

(51) Int. Cl.
*D04B 21/06* (2006.01)

(52) U.S. Cl.
CPC ..... *D04B 21/06* (2013.01)

(58) Field of Classification Search
CPC ..... D04B 21/06; D04B 21/08; D04B 21/10; D04B 21/12; A43B 1/04
See application file for complete search history.

(56) References Cited

U.S. PATENT DOCUMENTS 10,194,711 B2 2/2019 Dua et al.
2005/0081402 A1* 4/2005 Orei ..... A43B 1/028 36/45
2010/0154256 A1* 6/2010 Dua ..... A43B 7/20 12/146 B
2012/0233882 A1* 9/2012 Huffa ..... A43B 23/0255 36/45
2012/0255201 A1* 10/2012 Little ..... A43D 111/00 12/142 R
2013/0269209 A1* 10/2013 Lang ..... A43B 1/028 12/146 C
2014/0352173 A1* 12/2014 Bell ..... A43B 1/04 28/165
2016/0095377 A1* 4/2016 Tamm ..... A43B 3/02 66/170
2019/0075889 A1 3/2019 Lang et al.

FOREIGN PATENT DOCUMENTS

| | | | |
|---|---|---|---|
| CN | 114232196 | A | 3/2022 |
| EP | 3641580 | B1 | 5/2022 |
| JP | 2020525088 | A | 8/2020 |
| WO | 2018236346 | A1 | 12/2018 |
| WO | 2023161382 | A1 | 8/2023 |

OTHER PUBLICATIONS

European Search Report issued Mar. 11, 2024 in corresponding European Application No. 23199614.1.

* cited by examiner

*Primary Examiner* — Danny Worrell
(74) *Attorney, Agent, or Firm* — Spencer Fane LLP

(57) ABSTRACT

An upper for a shoe includes a knitted fabric including a first region including a continuous series of stitches with a yarn having a thickness of 0.1 mm or more, in which $4.0<nR<12.7$ is satisfied in the first region, where n is the number of stitches per inch along at least one direction, and R is the thickness of the yarn.

17 Claims, 4 Drawing Sheets

UPPER AND SHOE

CROSS-REFERENCE TO RELATED APPLICATIONS

The present application claims priority to and incorporates by reference the entire contents of Japanese Patent Application No. 2022-162150 filed in Japan on Oct. 7, 2022.

BACKGROUND

Technical Field

The present disclosure relates to an upper and a shoe including the upper.

Background Information

A shoe generally includes a sole that covers a sole of a foot and an upper that covers an instep of the foot (see, for example, JP 2020-525088 A). As a material constituting the upper, a knitted fabric formed by arranging a series of stitches can be used. The stitches are formed by making a yarn into a chain shape and hooking chain-shaped parts together.

SUMMARY t has been determined that an upper is required to have flexibility to be deformed following the deformation of a foot of a wearer of a shoe during walking and running, and air permeability for reducing humidity inside the shoe. In addition to these functions, with the recent diversified needs of wearers, an upper can be required to have a pleasant feel texture.

The present disclosure has been made in view of the above, and a purpose thereof is to obtain an upper formed of a knitted fabric and having a pleasant feel texture.

In order to solve the above problem and achieve the object, an upper for a shoe according to the present disclosure is formed of a knitted fabric including a first region including a continuous series of stitches with a yarn having a thickness of 0.1 mm or more, wherein $4.0<nR<12.7$ is satisfied in the first region, where n is the number of stitches per inch along at least one direction, and R is the thickness of the yarn.

DETAILED DESCRIPTION OF THE PREFERRED EMBODIMENTS

Hereinafter, an embodiment of an upper and a shoe according to the present disclosure will be described in detail with reference to the drawings. Note that the present disclosure is not limited by the embodiment. In the following description, the same portions are denoted by the same reference signs, and redundant description will be omitted.

First Embodiment

Figure 1:
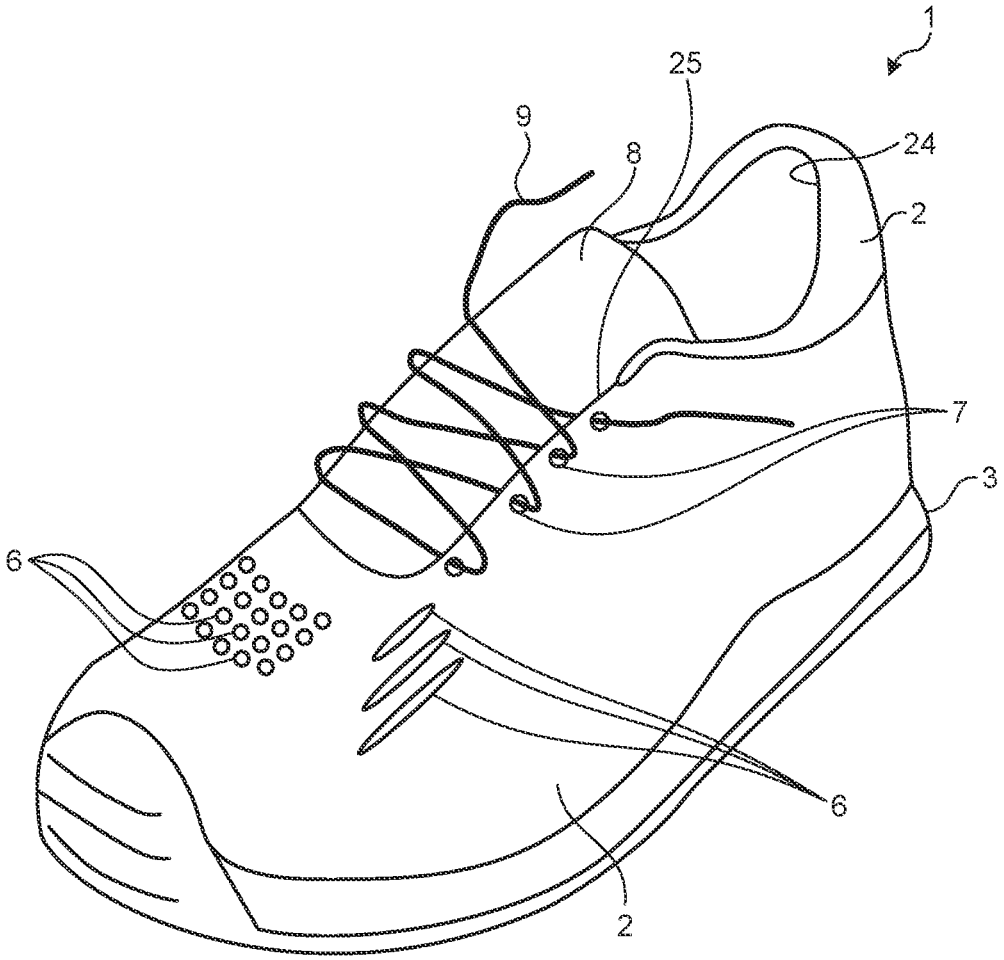
FIG. 1 is a perspective view of a shoe according to a first embodiment of the present disclosure.

FIG. 1 is a perspective view of a shoe according to a first embodiment of the present disclosure. In the drawings including FIG. 1, only a shoe 1 for a left foot is illustrated. Since the shoe 1 has a right-left symmetrical structure for a left foot and a right foot, only the shoe 1 for a left foot is described in the present embodiment, and the description of the shoe 1 for a right foot is omitted. In the following description, a direction in which a shoe center axis C, which is a perpendicular line passing through the center of shoe 1 in a plan view of the shoe 1, extends is referred to as a fore-rear direction, and a direction orthogonal to the fore-rear direction in the plan view of the shoe 1 is referred to as a foot width direction.

In the following description, a direction from the heel toward the toe of the shoe 1 in the fore-rear direction is referred to as a fore, and a direction from the toe toward the heel of the shoe 1 in the fore-rear direction is referred to as a rear.

In the following description, a median side of a foot in the anatomical position is referred to as a medial foot side, and the side opposite to the median side of the foot in the anatomical position is referred to as a lateral foot side. That is, the side closer to the median line in the anatomical position is referred to as the medial foot side, and the side farther from the median line in the anatomical position is referred to as the lateral foot side.

In the following description, a vertical direction means a direction orthogonal to both the fore-rear direction and the foot width direction unless otherwise specified.

The shoe 1 is preferably a running shoe but may be a shoe for other sports, a walking shoe, a climbing shoe, or the like. The shoe 1 includes an upper 2, a shoe tongue 8, and a sole 3.

As illustrated in FIG. 1, the upper 2 is positioned above the sole 3. The upper 2 covers an instep side part of a foot of a wearer. The upper 2 is disposed with a foot insertion opening 24 and a throat portion 25 at its upper portion. The foot insertion opening 24 is an opening for inserting the foot of the wearer into the upper 2. The throat portion 25 is an opening communicating with the foot insertion opening 24 and extending to the fore side from the foot insertion opening 24. On both side edges of the throat portion 25 in the foot width direction, a plurality of string passing portions 7 spaced apart from each other in the fore-rear direction is disposed. FIG. 1 illustrates only the string passing portions 7 disposed on the lateral-foot-side side edge of the throat portion 25. The string passing portions 7 allows a shoelace 9 to pass through. The string passing portions 7 are, for example, through holes that pass through the upper 2.

The throat portion 25 is disposed with the shoe tongue 8. The shoe tongue 8 is a member for protecting the instep of the wearer. The shoe tongue 8 covers the throat portion 25 that is an opening. The shoe tongue 8 is fixed to the upper 2 by stitching, welding, bonding, or a combination thereof. Note that the upper 2 and the shoe tongue 8 may be integrally formed to be a monosock structure.

The shoelace 9 is a string-like member that is alternately passed through the string passing portions 7 disposed at one side edge of the throat portion 25 in the foot width direction and the string passing portions 7 disposed at the other side edge in the foot width direction. The shoelace 9 is detachably attached to the upper 2. By pulling the shoelace 9 to narrow the width of the throat portion 25, the degree of close contact of the upper 2 with the foot, that is, the degree of tightening of the shoe 1 can be adjusted.

The means for bringing the upper 2 into close contact with the foot is not limited to the shoelace 9, and may be, for example, a hook-and-loop fastener. In a case in which the means for bringing the upper 2 into close contact with the foot is a hook-and-loop fastener, the shoelace 9 is no longer needed, and thus it is not necessary to dispose the string passing portions 7 in the upper 2.

The sole 3 is positioned below the upper 2. The sole 3 covers the sole of the wearer. The sole 3 is fixed to the upper 2 by stitching, welding, bonding, or a combination thereof. The sole 3 reduces impact on the foot of the wearer during walking and running.

Figure 2:
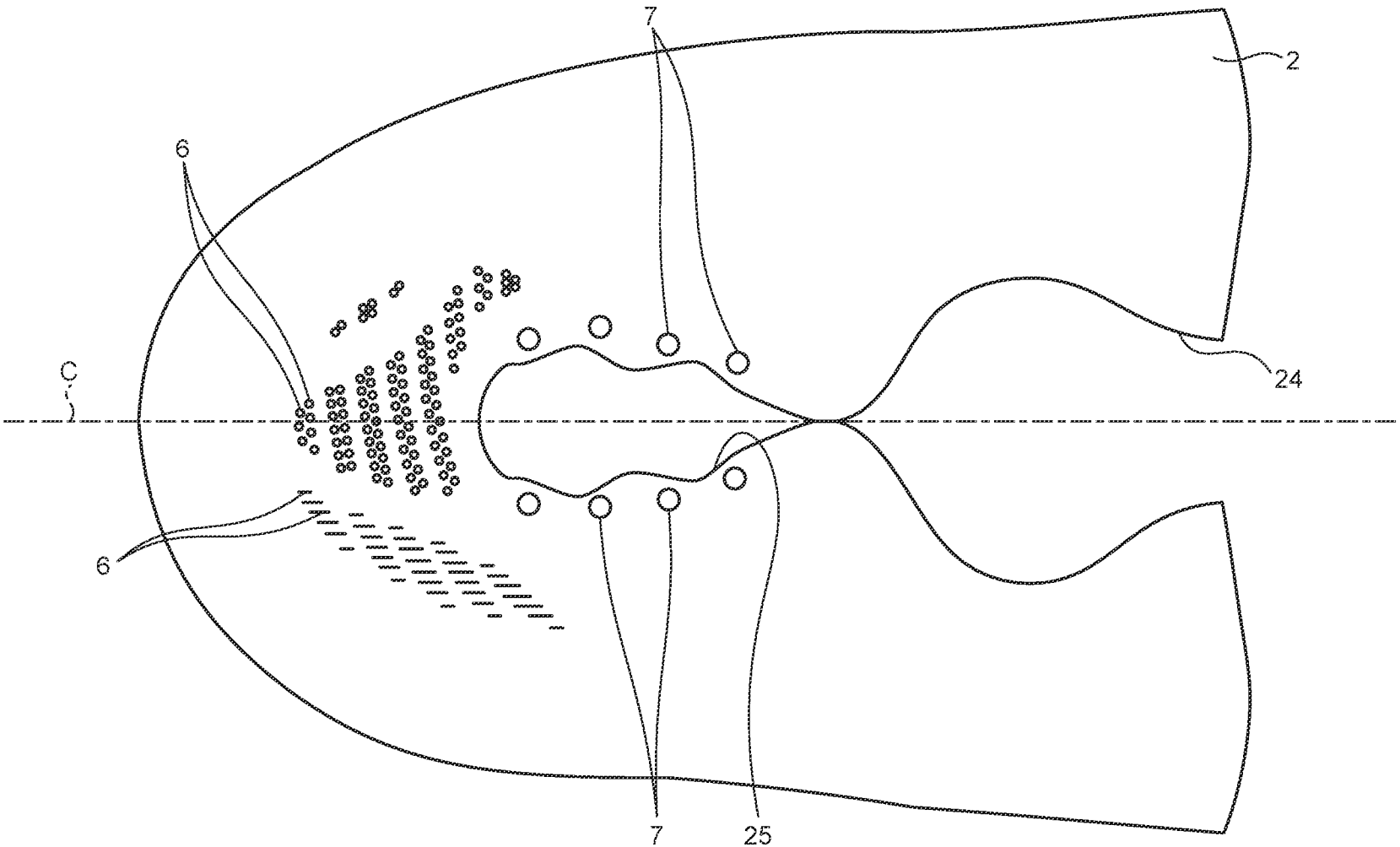
FIG. 2 is a developed view of an upper according to the first embodiment.

Next, a detailed configuration of the upper 2 will be described. FIG. 2 is a developed view of the upper according to the first embodiment.

Figure 3:
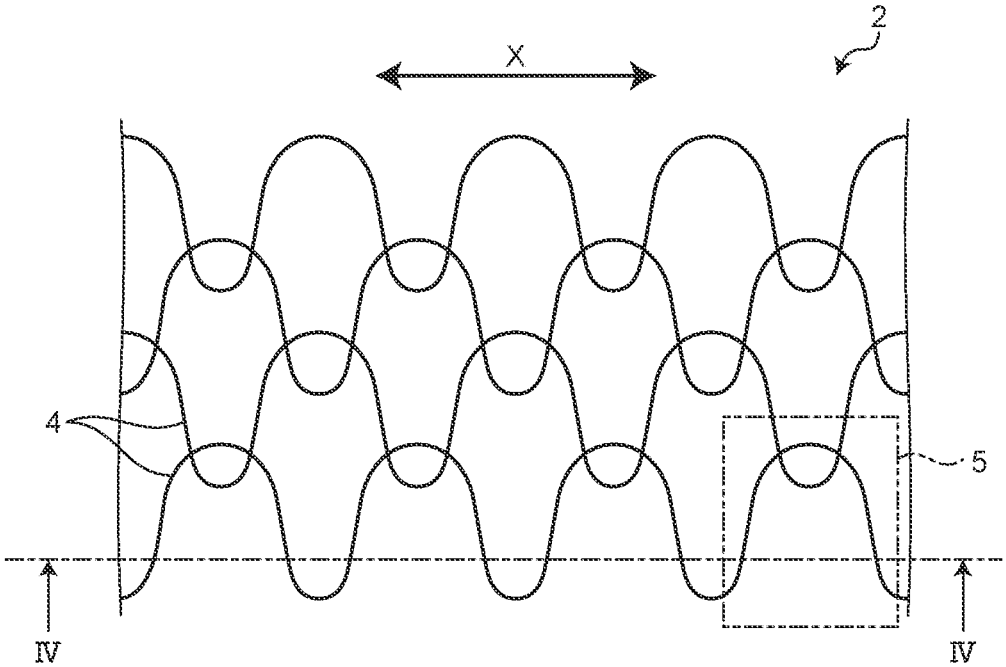
FIG. 3 is a view schematically illustrating an extracted part of the upper according to the first embodiment.

FIG. 3 is a view schematically illustrating an extracted part of the upper according to the first embodiment. As illustrated in FIG. 3, the upper 2 is a knitted fabric made by forming a yarn 4 into a chain shape and hooking the chain-shaped parts together to be a cloth. The upper 2 is disposed by arranging a series of stitches 5.

Figure 4:
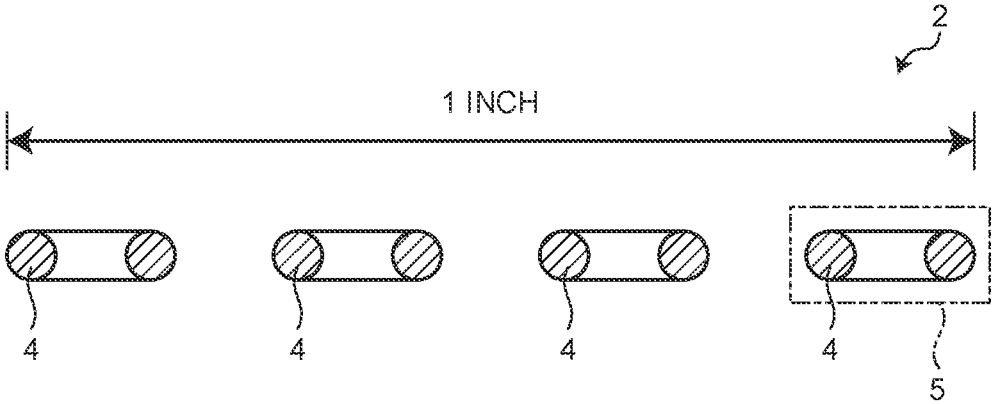
FIG. 4 is a cross-sectional view of the upper illustrated in FIG. 3 taken along line IV-IV.

FIG. 4 is a cross-sectional view of the upper illustrated in FIG. 3 taken along line IV-IV. When the thickness of the yarn 4 is R [mm], and the number of stitches 5 arranged within one inch along the direction of the series of stitches 5 is n, $$4.0<nR<12.7 \quad (1)$$

is satisfied. Note that, an actual cross-sectional shape of the yarn cut along a plane perpendicular to the length direction is not necessarily a circular shape, and may be various shapes including an elliptical shape, a polygonal shape, and a star shape. Therefore, it can be difficult to simply derive the diameter from the cross-sectional shape of the yarn. For this reason, the thickness of the yarn in the present embodiment is assumed to be the diameter of a circular shape having the same area as the cross-sectional area of the yarn.

Here, one of the parts at which the yarn is folded back into a U shape is one stitch 5. That is, in the cross-sectional view illustrated in FIG. 4, two threads of the yarn 4 form one stitch 5.

For example, when the thickness R. of the yarn 4 having a circular cross-sectional shape is 0.17 [mm], the number n of the stitches 5 is 24<n<74. In the case of 24≥n, the stitches 5 of the upper 2 become coarse and does not dispose a pleasant feel texture. On the other hand, in the case of n≥74, the stitches 5 of the upper 2 can be fine and dispose a pleasant feel texture, but the stitches 5 are too tight and the flexibility of the upper 2 is impaired. The upper 2 is required to have flexibility to be deformed following the deformation of the shape of a foot of a wearer wearing the shoe 1 during walking or running, and a knitted fabric with the tight stitches 5 and impaired flexibility is not suitable for the upper 2. Nate that a denier can be used as a unit to indicate the thickness of the yarn 4, and the yarn 4 having a thickness of 0.17 [mm] described above is equivalent to 150 deniers for a polyester fiber having a circular cross-sectional shape.

The thickness R of the yarn 4 is preferably R≥0.1 [mm]. If the thickness R of the yarn 4 is thinner than 0.1 [mm], the gap between the stitches 5 becomes small, and the air permeability can be impaired. In addition, the strength of the yarn 4 can be insufficient, which causes the strength of the upper 2 to be insufficient. Note that the thickness R of the yarn 4 is more preferably 0.12 [mm] or more, still more preferably 0.15 [mm] or more. Furthermore, the thickness R of the yarn 4 is even more preferably 0.17 [mm] or more.

In addition, the thickness R of the yarn 4 is preferably R≤0.4 [mm]. If the thickness R of the yarn 4 is thicker than 0.4 [mm], the unevenness of the surface of the upper 2 becomes large, and the pleasant feel texture of the upper 2 is impaired. Note that the thickness R of the yarn 4 is more preferably 0.38 [mm] or less, and still more preferably 0.35 [mm] or less. Furthermore, the thickness R of the yarn 4 is even more preferably 0.30 [mm] or less.

Note that, when a region in which the thickness R of the yarn and the number n of the stitches satisfy the relationship of Expression (1) is defined as a first region, the upper 2 may include a second region that does not satisfy the relationship of Expression (1). For example, the second region may be a portion that is less deformed during walking and running, or a portion in which the design is to be enhanced by surface unevenness. In the second region, the thickness R of the yarn 4 may be R<0.1 [mm] or R>0.4 [mm].

As described above, by providing the first region and the second region in the upper 2, the pleasant feel texture, air permeability, and the like can be made different for each portion of the shoe 1. For example, the first region can be disposed at a portion that is frequently in contact with the wearer and is required to have a pleasant feel texture, and the second region can be disposed at a portion that covers a part that perspires frequently and is required to have air permeability by coarsely arranging the stitches 5.

The method of firming the upper 2 as a knitted fabric may be warp knitting, weft knitting, or circular knitting. In the case of forming the upper 2 by warp knitting, the yarn 4 is knitted while being stretched in the direction indicated by the arrow X in FIG. 3 and is shrunk after knitting in the direction indicated by the arrow X to obtain the upper 2 with the tight stitches 5.

As illustrated in FIG. 2, the upper 2 is disposed with a plurality of uneven structures 6. The uneven structures 6 are, for example, recesses recessed from the outside toward the inside of the shoe 1 or recesses recessed from the inside toward the outside of the shoe 1. That is, the uneven structures 6 are formed by differences in thickness of the upper 2. The uneven structures 6 may be, for example, through holes that pass through the inside and the outside of the upper.

Note that some of the regularly arranged stitches 5 may be irregularly skipped or the thickness may be irregularly changed to dispose the uneven structures 6 independent of the stitches 5. In addition, some of the regularly arranged stitches 5 may be regularly skipped or the thickness may be regularly changed to dispose the uneven structures 6 along with the stitches 5. Note that the recesses or the through holes as the uneven structures 6 may each have a circular shape or a substantially rectangular shape. In addition, the interval between the uneven structures 6 and the area of each uneven structure 6 may be freely designed.

Figure 5:
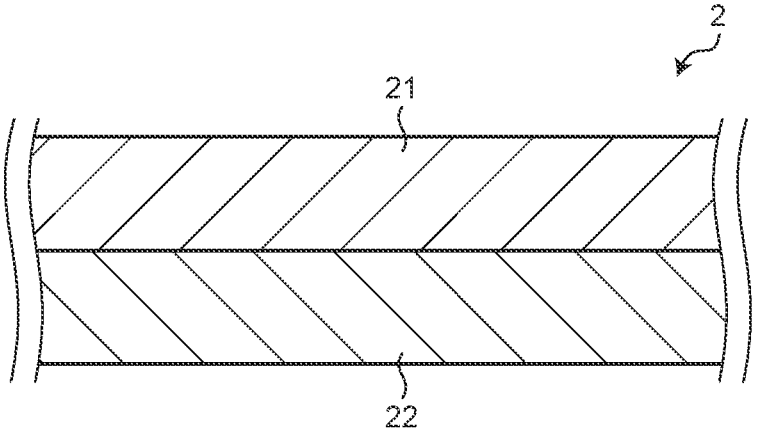
FIG. 5 is a view schematically illustrating an example of a cross-sectional structure of the upper according to the first embodiment.

FIG. 5 is a view schematically illustrating an example of a cross-sectional structure of the upper according to the first embodiment. As illustrated in FIG. 5, the upper 2 may have a two-layer structure including a surface layer 21 facing the outside of the shoe 1 and an inner layer 22 facing the inside. In the two-layer upper 2 including the surface layer 21 and the inner layer 22, the uneven structures 6 may be formed by recesses formed in at least one of the surface layer 21 and the inner layer 22. The uneven structures 6 may be formed by through holes that pass through the surface layer 21 and the inner layer 22.

Figure 6:
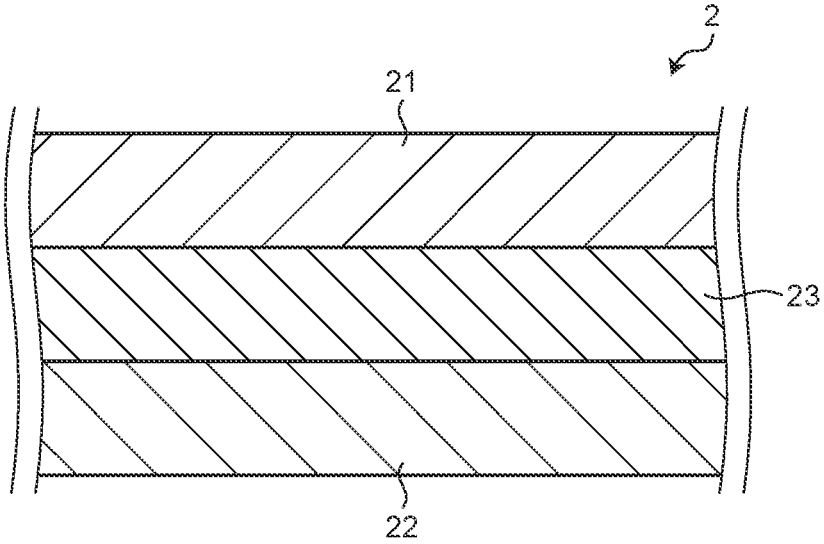
FIG. 6 is a view schematically illustrating another example of the cross-sectional structure of the upper according to the first embodiment.

FIG. 6 is a view schematically illustrating another example of the cross-sectional structure of the upper according to the first embodiment. As illustrated in FIG. 6, the upper 2 may have a three-layer structure including an intermediate layer 23 between the surface layer 21 and the inner layer 22 in addition to the surface layer 21 and the inner layer 22 illustrated in FIG. 5. In the three-layer upper 2 including the surface layer 21, the inner layer 22, and the intermediate layer 23, the uneven structures 6 may be formed by recesses formed in at least one of the surface layer 21 and the inner layer 22. Alternatively, the uneven structures 6 may be formed by through holes that pass through the surface layer 21, the inner layer 22, and the intermediate layer 23.

Note that, in the case of a multilayer structure illustrated in FIGS. 5 and 6, some of the regularly arranged stitches 5 may be irregularly skipped or the thickness may be irregularly changed to dispose the uneven structures 6 independent of the stitches 5. In addition, some of the regularly arranged stitches 5 may be regularly skipped or the thickness may be regularly changed to dispose the uneven structures 6 along with the stitches 5. The uneven structures 6 may each have a circular shape or a substantially rectangular shape. In addition, the interval and area between the adjacent uneven structures 6 may be freely designed.

The yarn 4 used for the upper 2 is, for example, a yarn obtained by bundling a plurality of fibers, a resin formed into a linear shape, a twisted yarn, or the like. The material of the yarn 4 is, for example, polyester, polyurethane thermoplastic elastomer, polyurethane, nylon, spandex, Kevlar (registered trademark), ultra-high-molecular-weight polyethylene, Single Covered Yarn (SCY) or Double Covered Yarn (DCY) covering polyurethane, or the like.

For the upper 2, a plurality of types of yarn 4 may be used, and the different types of yarn 4 may be different in at least one of material, thickness IR, and elastic modulus. In addition, the different types of yarn 4 may be different in at least one of softening point and melting point. The types of yarn used for the upper 2 are not limited to two, and may be three or more.

When the upper 2 has a multilayer structure including a plurality of layers as illustrated in FIGS. 5 and 6, the elasticity of the yarn 4 used for the surface layer 21 may be higher than the elasticity of the yarn 4 used for the intermediate layer 23 and the yarn 4 used for the inner layer 22. For example, a multifilament can be used as the highly elastic yarn 4 used for the surface layer 21. For example, a TPU multifilament can be used as the highly elastic yarn 4 used for the surface layer 21. For example, Poly-Trimethylene-Terephthalate (PTT) can be used as the yarn 4 used for the surface layer 21. In addition to its high elasticity, Poly-Trimethylene-Terephthalate is plant-derived, which reduces environmental burdens.

Furthermore, the yarn 4 used for the intermediate layer 23 or the inner layer 22 may be Poly-Ethylene-Terephthalate (PET).

When the upper 2 has a multilayer structure including a plurality of layers as illustrated in FIGS. 5 and 6, through holes may be disposed in the surface layer 21 and the intermediate layer 23, and the through holes may be closed with the inner layer 22 to form the uneven structures 6 that are recesses. Note that through holes may be disposed only in the surface layer 21, and the through holes may be closed with the intermediate layer 23 and the inner layer 22.

When the upper 2 has a multilayer structure including a plurality of layers as illustrated in FIGS. 5 and 6, the color of the yarn 4 used for each layer may be different. When the through holes disposed in the surface layer 21 and the intermediate layer 23 is closed with the inner layer 22 as described above, the color of the yarn 4 used for the inner layer 22 can be visually recognized through the through holes.

Hereinafter, various aspects of the present disclosure are described.

An upper according to a first aspect is formed of a knitted fabric including a first region including a continuous series of stitches with a yarn having a thickness of 0.1 mm or more, in which $4.0<nR<12.7$ is satisfied in the first region, where n is the number of the stitches per inch along at least one direction, and R is the thickness of the yarn.

In an upper according to a second aspect, the yarn has a thickness of 0.4 mm or less in the upper according to the first aspect.

In an upper according to a third aspect, the knitted fabric has a second region having a continuous series of stitches with a yarn thinner than 0.1 mm or thicker than 0.4 mm in the upper according to the second aspect.

In an upper according to a fourth aspect, two or more types of yarn different in at least one of material, thickness, and elastic modulus are used as the yarn in the upper according to any one of the first to third aspects.

In an upper according to a fifth aspect, two or more types of yarn different in at least one of softening point and melting point are used as the yarn in the upper according to any one of the first to third aspects.

In an upper according to a sixth aspect, the knitted fabric has an uneven structure in the according to any one of the first to fifth aspects.

In an upper according to a seventh aspect, the uneven structure is a hole disposed in the knitted fabric in the upper according to the sixth aspect.

In an upper according to an eighth aspect, the uneven structure is formed by differences in thickness of the knitted fabric in the upper according to the seventh aspect.

In an upper according to a ninth aspect, the uneven structure is irregularly disposed independently of the stitches of the knitted fabric in the upper according to the sixth aspect.

In an upper according to a tenth aspect, the knitted fabric has a layer structure of two or more layers including a surface layer facing an outside of the shoe and an inner layer facing an inside of the shoe in the upper according to any one of the first to fifth aspects.

In an upper according to an eleventh aspect, the knitted fabric has an uneven structure in at least one of the inner layer and the surface layer in the upper according to the tenth aspect.

In an upper according to a twelfth aspect, the uneven structure is a hole disposed in the knitted fabric in the upper according to the eleventh aspect.

In an upper according to a thirteenth aspect, the uneven structure is formed by differences in thickness of the knitted fabric in the upper according to the eleventh aspect.

In an upper according to a fourteenth aspect, the uneven structure is irregularly disposed independently of the stitches of the knitted fabric in the upper according to the eleventh aspect.

In an upper according to a fifteenth aspect, the knitted fabric is warp knitted in the upper according to any one of the first to fourteenth aspects.

A shoe according to a sixteenth aspect includes the upper according to any one of the first to fifteenth aspects and a sole positioned below the upper.

An upper according to the present disclosure has an effect of being able to obtain an upper formed of a knitted fabric and having a pleasant feel texture.

What is claimed is:

1. An upper for a shoe, comprising:

a knitted fabric including a first region formed by a continuous series of stitches with a yarn having a diameter of 0.1 mm or more, the diameter of the yarn being a diameter of a circular shape having a same cross-sectional area as the yarn, and the first region being defined as a region in which an equation $4.0<nR<12.7$ is satisfied throughout an entirety of the region, where n is the number of stitches per inch along at least one direction, and R is the diameter of the yarn.

2. The upper according to claim 1, wherein the yarn has a diameter of 0.4 mm or less.

3. The upper according to claim 2, wherein the knitted fabric includes a second region including a continuous series of stitches with a yarn having a diameter less than 0.1 mm or greater than 0.4 mm.

4. The upper according to claim 1, wherein two or more types of yarn different in at least one of material, diameter, and elastic modulus are used as the yarn.

5. The upper according to claim 1, wherein two or more types of yarn different in at least one of softening point and melting point are used as the yarn.

6. The upper according to claim 1, wherein the knitted fabric has an uneven structure.

7. The upper according to claim 6, wherein the uneven structure is a hole disposed in the knitted fabric.

8. The upper according to claim 6, wherein the uneven structure is formed by differences in diameter of the knitted fabric.

9. The upper according to claim 6, wherein the uneven structure is irregularly disposed independently of the stitches of the knitted fabric.

10. The upper according to claim 1, wherein the knitted fabric has a layer structure of two or more layers including a surface layer and an inner layer.

11. The upper according to claim 10, wherein the knitted fabric has an uneven structure in at least one of the inner layer and the surface layer.

12. The upper according to claim 11, wherein the uneven structure is a hole disposed in the knitted fabric.

13. The upper according to claim 11, wherein the uneven structure is formed by differences in diameter of the knitted fabric.

14. The upper according to claim 11, wherein the uneven structure is irregularly disposed independently of the stitches of the knitted fabric.

15. The upper according to claim 1, wherein the knitted fabric is warp knitted.

16. A shoe comprising:

the upper according to claim 1; and a sole positioned below the upper.

17. The upper according to claim 1, wherein the yarn forming the continuous series of stitches is a single yarn and R is the diameter of the single yarn.

* * * * *